United States Patent [19]

Cleland et al.

[11] 4,079,328

[45] Mar. 14, 1978

[54] AREA BEAM ELECTRON ACCELERATOR HAVING PLURAL DISCRETE CATHODES

[75] Inventors: Marshall Robert Cleland, Huntington Station; Kennard Harold Morganstern, Roslyn, both of N.Y.; Peter Ronald Hanley, Rowley, Mass.

[73] Assignee: Radiation Dynamics, Inc., Melville, N.Y.

[21] Appl. No.: 725,334

[22] Filed: Sep. 21, 1976

[51] Int. Cl.[2] ..... H01J 1/18; H05H 5/02

[52] U.S. Cl. ..... 328/233; 313/147; 313/420; 315/58; 315/334

[58] Field of Search ..... 328/233, 227; 313/420, 313/146, 147; 315/58, 48, 334

[56] References Cited

U.S. PATENT DOCUMENTS

| | | | |
|---|---|---|---|
| 1,585,878 | 5/1926 | Rugh | 315/58 X |
| 2,887,599 | 5/1959 | Trump | 313/420 |
| 3,034,012 | 5/1962 | Gasson | 313/146 |
| 3,144,552 | 8/1964 | Schonberg et al. | 313/420 X |
| 3,780,334 | 12/1973 | Leboutet | 313/420 X |
| 3,816,790 | 6/1974 | Arakawa et al. | 313/420 X |
| 3,956,712 | 5/1976 | Hant | 313/420 X |

*Primary Examiner*—Palmer C. Demeo
*Attorney, Agent, or Firm*—Rose & Edell

[57] ABSTRACT

An area beam of electrons capable of delivering large doses of electron irradiation at small dose rates and having a predetermined distribution pattern is provided by an electron accelerator comprising plural discrete cathodes positioned as required to achieve the desired pattern. An individual emission control is provided for the filament of each cathode. In a preferred embodiment plural cathodes are movably mounted in a row extending transversely of the transport path of material to be irradiated, a plurality of such rows being positioned along the direction of transport.

14 Claims, 9 Drawing Figures

AREA BEAM ELECTRON ACCELERATOR HAVING PLURAL DISCRETE CATHODES

BACKGROUND OF THE INVENTION

The present invention relates to electron beam accelerators and has particular utility in the high speed irradiation of thin layers of material. Important advantages of the present invention relate to improved control over the dose distribution in the irradiated material and to the ability to provide a high dose at a low dose rate during a single pass of the material.

It is common to irradiate material with accelerated electrons by passing the material, via a conveyor, through an electron beam. Stationary columnar beams, scanning columnar beams, and elongated sheet-like beams have been employed to effect irradiation for various purposes, such as sterilization, paint hardening, and material curing in general. All prior art approaches to electron beam irradiation processes have had a common deficiency, namely the lack of a simple and accurate means by which the dose distribution pattern in the irradiated material could be varied as required by the particular curing process to be performed. For example, a great many irradiation processes, such as paint hardening, require that the irradiation dose be uniformly distributed across the treated material. Others, such as vulcanization of rubber wherein the edges of the material are only partially cured, require specific non-uniform dose distributions. To change from uniform to non-uniform dose distribution, or from one non-uniform dose distribution pattern to another, is impossible or exceedingly difficult in prior art electron acceleration tubes.

For example, consider the stationary columnar electron beam. This beam must be provided with a relatively large dimension in the direction transverse to material movement in order that all or a significant portion of the material be irradiated in a single pass; minimizing the number of passes, and decreasing the cost of the process. However, it is extremely difficult to accurately control the electron density, and hence the dose pattern distribution, in a columnar beam of large cross-section. Moreover, to effect a large dose in a single pass, the beam current must be relatively high, and a stationary columnar beam of high current presents severe window problems. Specifically, the continuous beam passing through a localized area in a window tends to heat the window to a point of weakened tensile strength whereby the window is subject to rupture by atmospheric pressure acting on one side against the interior vacuum on the other side.

The scanning beam approach was employed to minimize the effects of window heating produced by the stationary beam. Specifically, and as disclosed in U.S. Pat. No. 2,602,751, a narrow electron beam is caused to scan the treated material transversely of the direction of material motion. An elongated window is employed, and since the beam is continuously moving it does not severely heat a localized area of the window. The scanning approach requires precise electronic circuitry to effect the desired dose distribution pattern across the conveyed irradiated material. For example, a precise saw tooth scanning waveform must be generated if a uniform dose distribution is required. Non-uniform dose distributions require other precise, and sometimes irregular waveforms. Moreover, the beam scanning approach may be uneconomical even for uniform dose distribution, such as where the treated material requires a large dose for curing but can only tolerate a small dose rate. To achieve the required large dose in a single pass, the scanning beam must have a relatively high intensity and therefore may exceed the permissible dose rate of the material. Multiple passes at lower beam intensities are thus required to achieve the overall dose, and the cost of the process increases significantly.

The electron accelerator tube disclosed in U.S. Pat. No. 2,887,599 to Trump comprises an elongated cathode which emits a sheet or curtain of electrons across the transverse dimension of the conveyed material to be treated. This tube has the advantage of not requiring complex scanning circuitry. Moreover, since the electrons are issued as an extended sheet rather than as a columnar beam, the same total beam current may be achieved with a lower instantaneous density, thereby minimizing window heating. However, the Trump tube is limited regarding the dose distribution it can produce in the treated material; once the distribution pattern is set it cannot be changed. Moreover, Trump's tube, although better than the scanning beam tube, is also unable to supply a large dose at low dose rates in a single pass of the treated material.

It is therefore an object of the present invention to provide an electron accelerator tube devoid of the aforementioned disadvantages inherent in the prior art. More particularly it is an object of the present invention to provide an electron accelerator capable of providing a dose distribution pattern which is easily adjusted and also capable of delivering large doses at small dose rates in a minimum number of passes of treated material.

It is another object of the present invention to provide an electron accelerator which is particularly suitable for irradiating conveyed thin film material with an area beam having a dose distribution pattern which is controllable both transversely and longitudinally of the direction of material motion.

SUMMARY OF THE INVENTION

In accordance with the principles of the present invention, an electron accelerator comprises plural discrete cathodes which emit an area beam of electrons through which material to be irradiated is conveyed, the cathodes including individual controls for adjusting the intensity of electron emission. In a preferred embodiment, the cathodes are arranged in groups, each group comprising a row of movable cathodes extending transversely of material conveyor path. Large doses can be delivered at low dose rates by several successive rows of discrete cathodes, the rows being positioned to irradiate conveyed material at successive locations along the conveyor path. The spacing between cathodes, the emission intensity of each cathode, and the geometry of the individual cathodes determines the overall distribution pattern of the area beam.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein.

DESCRIPTION OF PREFERRED EMBODIMENTS

Figure 1:
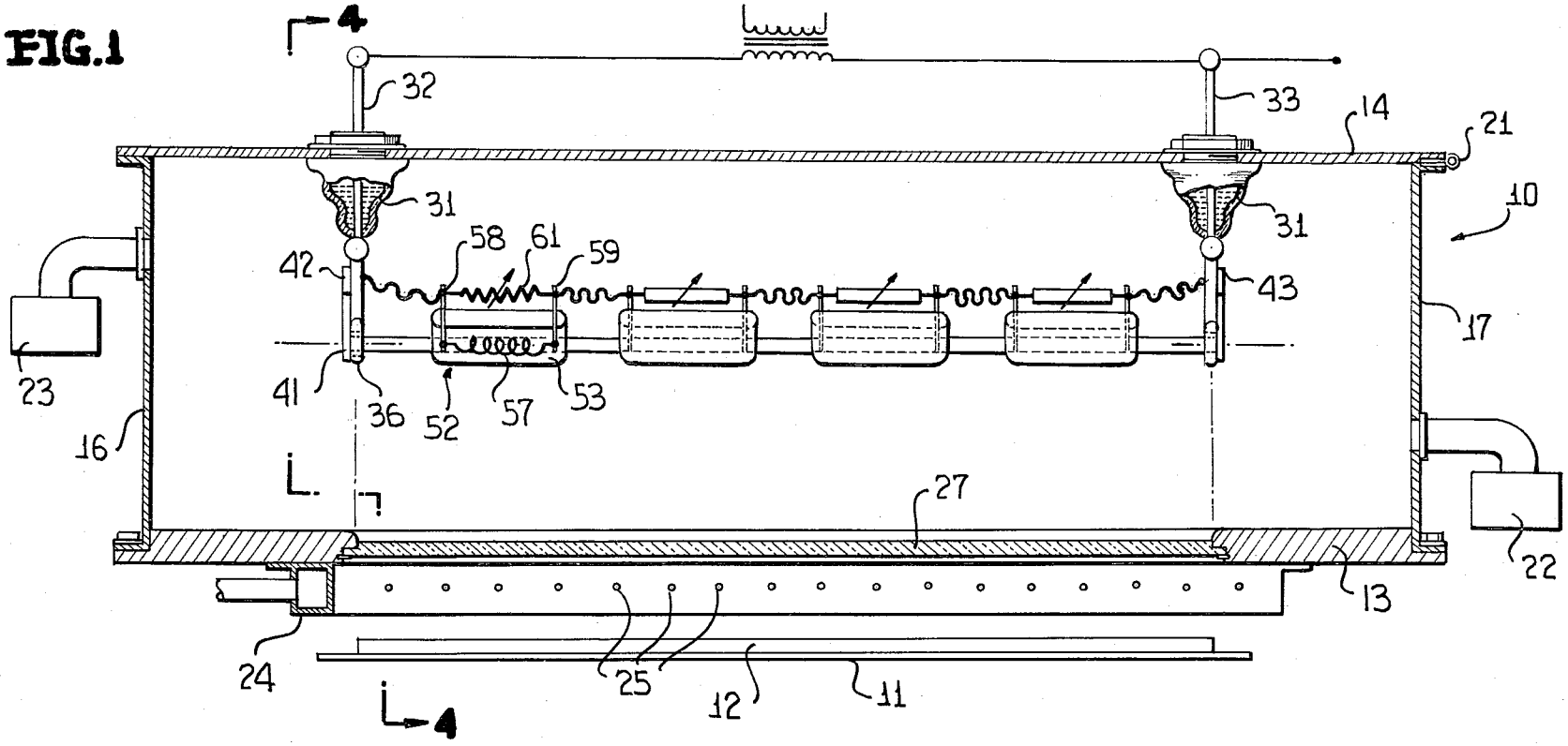
FIG. 1 is a longitudinal view in section of an electron acceleration unit embodying the present invention.
Figure 4:
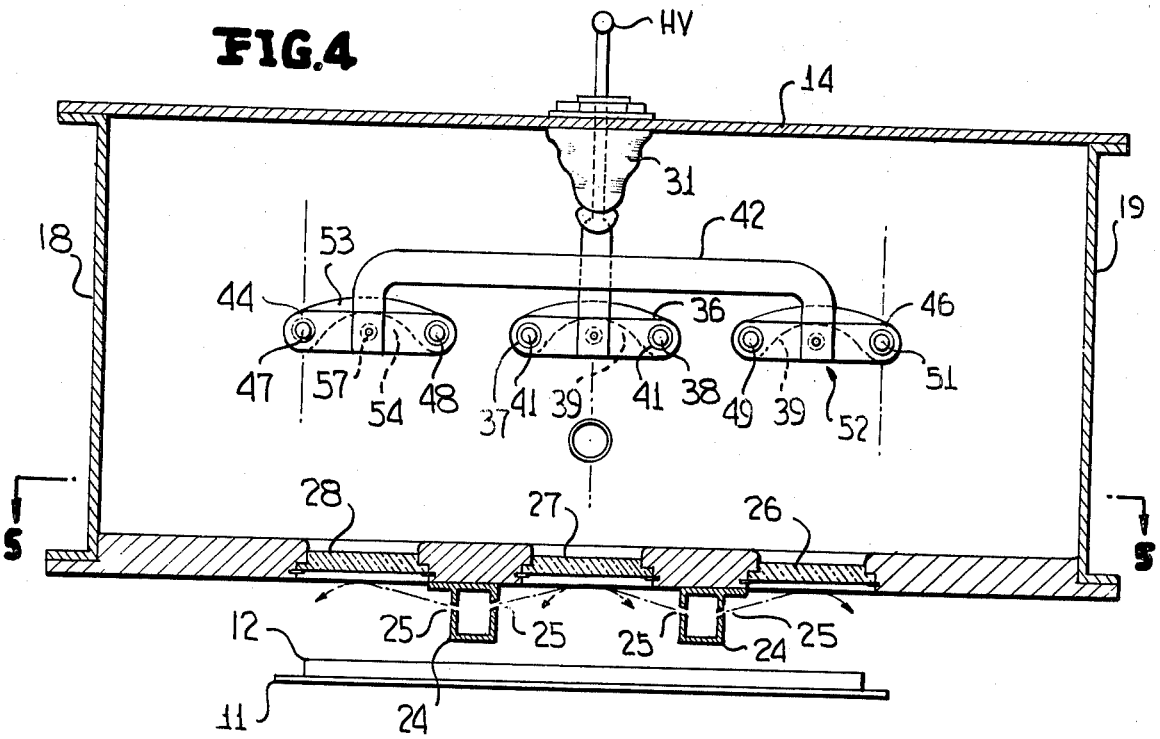
FIG. 4 is a view along lines 4—4 in FIG. 1.
Figure 5:
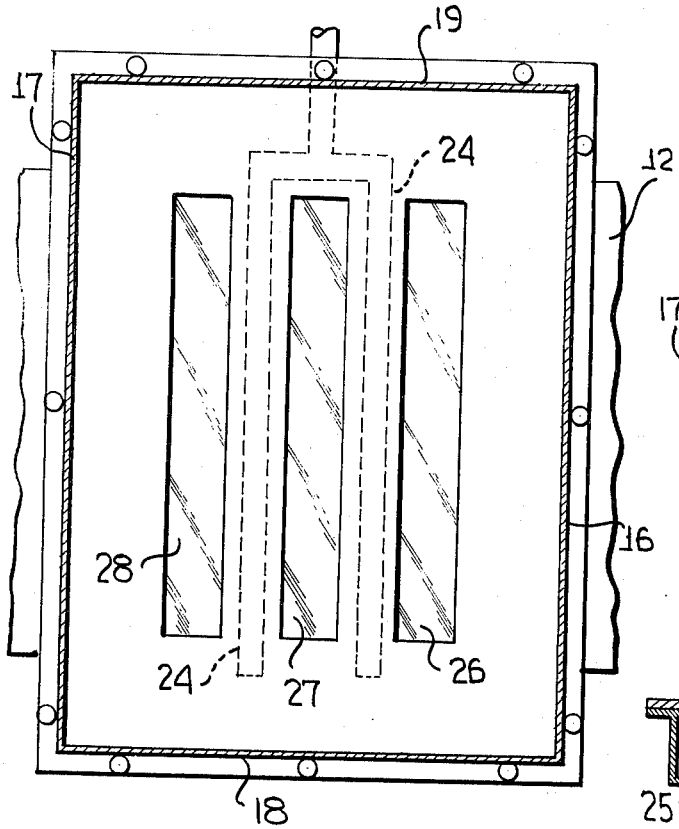
FIG. 5 is a view along lines 5—5 in FIG. 4.

Referring specifically to FIGS. 1, 4 and 5, an electron accelerator unit 10 suitable for use up to 150–200 kV is arranged above a conveyor 11 to irradiate material 12 transported by the conveyor. The direction of conveyor motion is into the plane of the drawing in FIG. 1 and to the left in FIGS. 4 and 5. Unit 10 is illustrated as being generally rectangular; however, this is by no means a requirement since, in accordance with the principles of the present invention, the unit may assume any configuration consistent with the desired operational characteristics. The unit as illustrated includes a rectangular grounded metal frame having a front wall 16 and a rear wall 17 joined by side walls 18 and 19. A grounded metal base plate 13 is secured to the bottom of the front and side walls and a grounded metal cover plate 14 is removably secured atop the frame by means of a hinge 21 or the equivalent. The frame walls and the cover and base plates define an enclosure capable of supporting a vacuum. A suitable pump 22 is employed initially to evacuate the tube interior and vacuum may be maintained by titanium sputter pump 23 or other suitable pump.

Three spaced elongated electron windows 26, 27, 28 are supported in respective elongated apertures in base plate 13, the three windows being arranged parallel to one another and parallel to both front wall 16 and rear wall 17. The number of windows employed may be more or less than three in accordance with considerations to be discussed below. An air manifold 24 runs along the bottom surface of base plate 13, extending between the windows, and is provided with ports 25 for directing pressurized air towards the outer surfaces of the windows for cooling purposes.

The apparatus illustrated in FIGS. 1, 4 and 5 is a diode-type structure suitable for use at voltages up to 150–200 kV. High voltage is introduced into the housing 10 through bushings 31. High voltage terminals 32 and 33 extend through the bushings and are supplied with negative high voltage from a source, not illustrated. A filament transformer 34 is connected between terminals 32 and 33 to develop a suitable heating voltage, for instance, 5 volts between the terminals.

The ends of the terminals 32 and 33 interiorly of the housing 10 supports a desired number of parallel cathode structures, one or more, with three being illustrated for purposes of example. Specifically terminal 32 carries a crossarm 36 which supports one end of two parallel rods 37 and 38. The rods 37 and 38 are supported at their other ends by crossarm 39 carried by terminal 33. The rods 37 and 38 are insulated by bushings 41 from cross-arm 36 to prevent short circuit of the filament voltage.

The terminals 32 and 33 supports transverse plates 42 and 43, respectively, each supporting two additional cross-arms; 44 and 46 associated with plate 42. Each of the cross-arms 44 and 46 supports a pair of parallel rods 47 and 48 and 49 and 51, respectively, insulated from the cross-arms as previously described. Identical supports, except for the insulating bushing are provided at the other ends of the rods 47, 48, 49 and 51 by corresponding structures associated with plate 43.

Each pair of rods 37 and 38 etc., supports a plurality, four being illustrated, of individual cathode members 52. Each of the individual cathode members includes a cathode 53 comprising an elongated member having a concave lower region 54, as illustrated in FIG. 4, and apertures 56 for receiving rods 37 and 38 for instance. The concave region 54 of the cathode is shaped to provide an electron beam of the desired configuration.

The apertures 56 of the cathode are of such a size that the rods 37 and 38 are frictionally engaged by the cathode and may therefore be moved along the rods to a desired position. It is apparent that other arrangements for movably mounting the cathodes are possible. The number and spacing of cathode members 52 along the various rod-pairs depends upon the dosage distribution desired for material 12, as will be described in detail subsequently.

The cathodes 53 may be conductive or non-conductive. If the rods are made of non-conductive material, the cathodes 53 may be fabricated entirely of conductive metal, such as aluminum. If the rods 37 and 38 are conductive each cathode must be insulated from the same one of the rods so that the filament current is not short circuited or the cathode must be fabricated from non-conductive material with a metallized coating on the concave face which extends into contact with one of the rods so that the negative high voltage is applied to the region of the cathode facing the bottom plate 13.

Within the concavity of each cathode 53 is secured a relatively short filament 57 which, for purposes of illustration, extends perpendicular, to the direction of movement of conveyor 11. Each filament 57, supported by conductive rods 58 and 59, is positioned above the longitudinal centerline of a window 26, 27 and 28. Connected in parallel with each filament 57 is an adjustable resistor 61. The configuration of the various filaments 57 and values of the various adjustable resistors 61 need not necessarily be the same for each cathode member. Moreover, since adjustable resistors 61 are employed to control the emission rate from filaments 57, equivalent elements, such as variable inductances, may be employed in their stead.

Each of the cathode members slidably mounted on the same rods 37, 38 are electrically connected in series between high voltage terminals 32, 33; that is, each parallel-connected filament 57 and resistor 61 is connected in series with each other parallel-connected filament 57 and resistor 61. Since terminals 32 and 33 are at the same negative high dc voltage, all filaments 57 are at that dc voltage. The ac filament voltage applied across terminals 32, 33 produces a flow of heater current through the filaments in accordance with the settings of the various adjustable resistors 61. In addition, the cathode 53 is placed at the negative dc high voltage by appropriate connection to one of the rods 58 and 59. If the cathode 53 is fabricated of conductive material one of the rods 58, 59 must be suitably insulated therefrom.

Instead of series-connections between cathodes on the same rod pair, parallel connections may be employed. The choice of series or parallel arrays of filaments depends primarily on the advantages in a particular installation of a high voltage, low current filament supply or a low voltage, high current filament supply, respectively. If parallel connections are employed, use of rods 37, 38 as one terminal for the filament voltage is rendered practical.

By virtue of the fact that each filament 57 is at a negative dc high voltage (on the order of one hundred or more kilovolts) and that the base plate 13 is at ground, electrons emitted from the heated filaments 57 are accelerated toward the base plate, which (along with the windows) serves as an anode, and through windows 26, 27 and 28 toward material 12. The effect of concave metal surfaces 39, also at negative high dc voltage, is to shape the electrostatic field between the filament and base plate thereby aiding in properly shaping the electron beam directed toward the window. The various beams emitted from a single group of cathodes are coplanar and, depending upon the spacing between cathode members 52, may overlap. As employed herein, the term group of cathodes refers to those cathode members supported along a common pair of rods such as rods 37, 38.

In operation, conveyor 11 transports the material 12 to be treated past the windows 26, 27, 28 through which the material is successively irradiated by the electrons emitted by the three groups of cathode structures. Each group of beams in turn comprises a plurality of beams in accordance with the number of cathode members 57 employed in each group. The dose distribution pattern produced by each group of cathode members depends upon the filament currents, filament and cathode configurations, and spacing between the cathode members.

Figure 2:
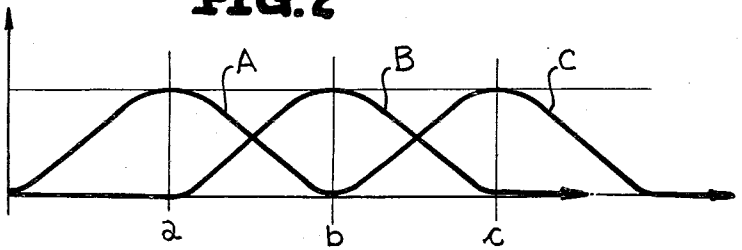
FIG. 2 is a diagram graphically representing the individual transverse distributions of electron radiation effected at the surface of material being irradiated by three respective individual cathodes employed in the unit of FIG. 1.

To illustrate the generation of a particular distribution pattern reference is made to FIG. 2 wherein curves A, B and C represent dose distribution patterns produced transversely of the moving material 12 by respective adjacent cathode members. For purposes of this description it is assumed that each of these cathode members extends linearly in an identical manner and is identically heated. It is to be understood however that the cathodes need not be linear in configuration nor identical in configuration and emission characteristics for purposes of this invention.

Figure 3:
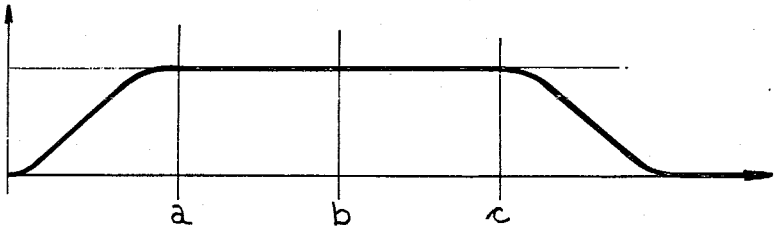
FIG. 3 is a diagram graphically representing the cumulative effects of the individual transverse distributions of electron radiation in FIG. 2.

Each of the patterns A, B and C has a peak dose level, at points *a, b* and *c* respectively, on either side of which the dose level trails off gradually, approximately a gaussian curve. For regions wherein distributions A, B and C overlap, the resulting dose distribution pattern is the sum of the individual distributions. If the spacing between the cathode members is properly chosen, the region between points *a* and *c* can be made one of nearly uniform distribution, as illustrated in FIG. 3. More specifically, the cathode members producing distribution curves A, B and C can be spaced so that at each point between points *a* and *c* the individual dose distributions sum to the same overall dose level. In this manner, uniform dose distribution may be effected across the entire transverse dimension of material 12, in which case the beam portions outside region *a–c* would be intercepted by the anode (wall 13). It will be apparent from the foregoing that cathode members 52 can be spaced to produce individual dose distribution patterns which sum to provide substantially any overall dose distribution pattern, uniform or not. Furthermore, for purposes of delivering an overall dose in a single pass, patterns A, B and C need not be produced by cathodes in the same group but rather may emanate from cathodes in successive groups as more fully explained in relation to FIG. 8.

The overall dose distribution pattern produced by electrons emerging from window 26 need not be the same as the pattern produced by electrons emerging from windows 27 or 28. The choice depends upon the requirements of the particular irradiation process. A major advantage of producing identical patterns from each window acrues where a particular material requires a high total dose but cannot tolerate a high dose rate. In this case, the material 12 may be irradiated with three (or more, if more cathode groups are provided) identical dose patterns in one pass, each dose being at a sufficiently low level so as not to exceed the dose rate tolerance of the material but being sufficiently high that the cumulative dose meets the total dosage requirements.

In addition to the number and positioning of cathode members 52 as factors determining the dose distribution pattern, the adjustability of resistors 61 or equivalent filament current control may be similarly utilized. Since each resistor is individually adjustable, the current through each filament 57 can be individually varied by shunting more or less current through resistor 61. The current through the filament determines the rate of electron emission so that the electron intensity in an individual electron beam may be controlled as determined by the setting of the resistor in parallel with that filament.

Figure 6:
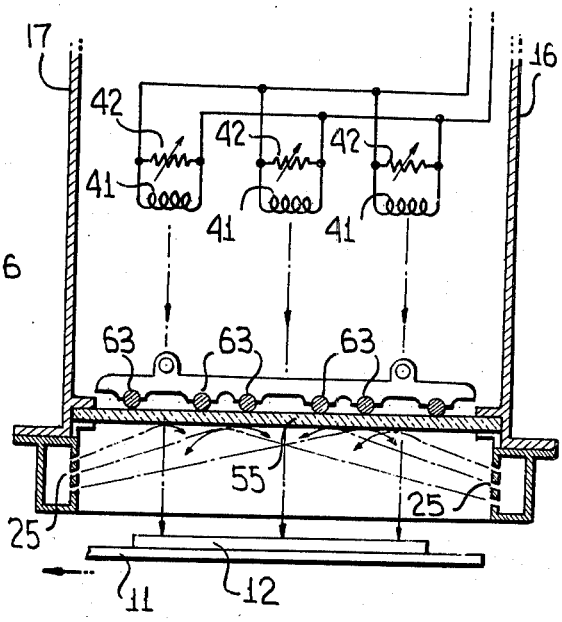
FIG. 6 is a sectional view, similar to FIG. 1, of an alternative embodiment of the present invention.

A modification of the unit illustrated in FIGS. 1, 4 and 5 is diagrammatically illustrated in FIG. 6 wherein like components are designated by like reference numerals. In FIG. 6, instead of providing individual windows for each group of cathode members, a single window 62 is provided and extends over substantially the entire bottom of the accelerator unit. Since segments of a grounded base plate are not present to serve as anode structures, conductive bars 63 are supported by conductive brackets 64 which are secured to sidewalls 18, 19 (not visible in FIG. 6). Bars 63 which are grounded via bracket 57 and sidewalls 18, 19, serve as anodes in this embodiment.

Figure 7:
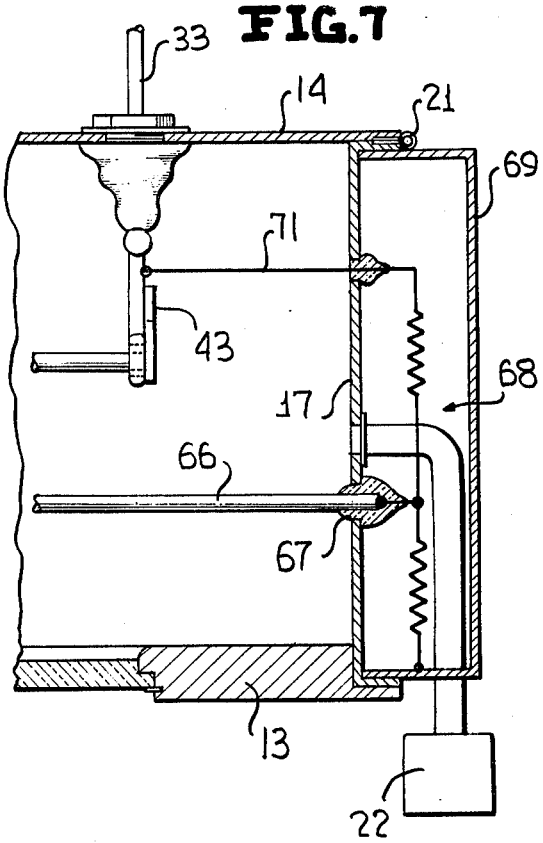
FIG. 7 is a partial longitudinal view in section of another alternative embodiment of the present invention.

Another modification of the accelerator unit is illustrated in FIGS. 7 and 8 wherein once again like components in FIGS. 1 and 7, and FIGS. 5 and 8 are designated by the same reference numerals. One aspect of the embodiment of FIGS. 7 and 8 which differs from that of FIGS. 1 and 5 is the provision of a plurality of accelerating electrodes 66, only one of which is illustrated in FIG. 7. The accelerating electrodes straddle the electron beams so as not to interfere with their free flow. The electrodes, which are conductive rods, pass through the wall 17 via appropriate insulating bushings 67 and are connected to a voltage dropping resistor string 68 to have an appropriate voltage applied thereto.

The resistor string 68 is located in a housing 69 maintained at an appropriate pressure to facilitate cooling and high voltage insulation of the resistors. High voltage may be applied to the top of the string 68 by means of a lead 71 proceeding from the terminal 33 through wall 17 via an appropriate bushing 72.

For a voltage of 150–200 kV and less electrodes are not required. At higher voltages such electrodes may be required to grade the potential and thus prevent discharges in the vacuum gap between the cathodes and the plate 13. Although only one set or level of accelerating electrodes is illustrated, additional levels may be employed as dictated by the total accelerating voltage.

Figure 8:
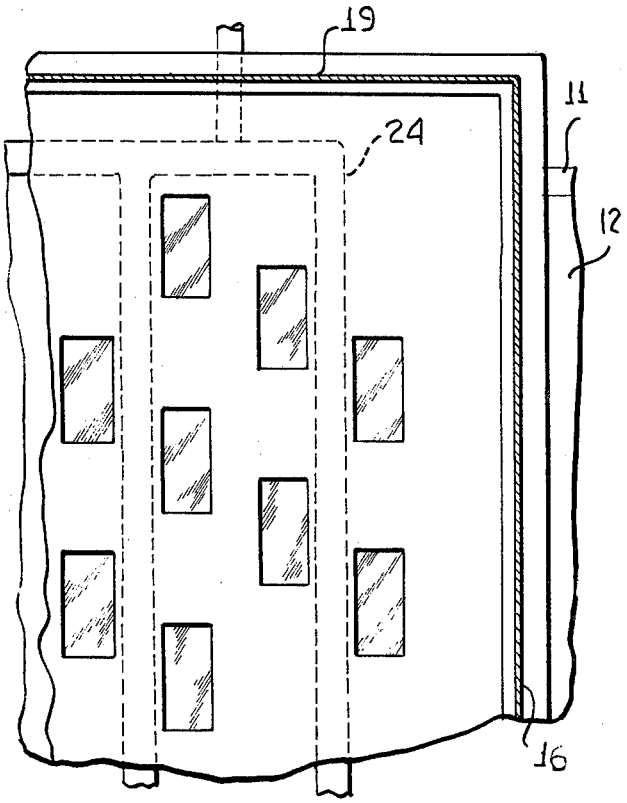
FIG. 8 is similar to FIG. 5 of the embodiment of FIG. 7.

Another important modification in FIGS. 7 and 8 concerns the provision of individual windows 73 for each cathode member 52 as opposed to a single elongated window (26, 27, 28) for each group of electrodes in FIGS. 1 and 5. Windows 73 are somewhat longer (transversely of conveyor 11) than filaments 57 to give effect to the positional adjustability of the various cathode members 52. Discrete windows 73 are more limiting on the distribution patterns which can be produced than are elongated windows 26, 27, 28; however, it is often difficult to find long lengths of window material which do not have one or more structural deficiencies. In other words, there is a trade-off between window reliability and area beam distribution adjustability, which trade-off can be consciously made for each application.

Another feature of the embodiments of FIGS. 7 and 8, particularly as illustrated in FIG. 8, is the provision of more than three cathode groups, the number of course being selectable for the particular performance desired. In addition, it is noted that windows 73 are staggered from group to group, as would be the cathodes in those groups. It will be appreciated that the illustrative pattern distribution plots in FIGS. 2 and 3 are applicable to three staggered electrodes in different groups. For example, consider electron beams emerging from windows $73_A$, $73_B$, and $73_C$ in FIG. 8. These beams may correspond to patterns A, B and C respectively in FIG. 2 and can be adjusted to produce a uniform pattern such as that between points *a* and *c* of FIG. 3. Thus, in this staggered configuration, each group of cathodes irradiates the material 12 with a group of parallel strips, and the area between the stripes is filled in by cathodes of succeeding groups.

Difficulty may be experienced with the arrangement of FIG. 7 at operations at voltages well over 150,000 volts due to build up of electrostatic charge on the interior of the walls and other internal elements of the vacuum chamber. The problem can be overcome in the embodiment of FIGS. 1, 4 and 5 by properly spacing the elements in the chamber. Specifically if the elements interior of the vacuum chamber in FIGS. 1, 4 and 5 are located such that none of the elements is closer to any wall than some specified distance, which is the function of the accelerating voltage the problem is manageable. In this approach were attempted in installations operating as well over 150,000 volts, however, the vacuum chamber would become so large as to be impractical.

Figure 9:
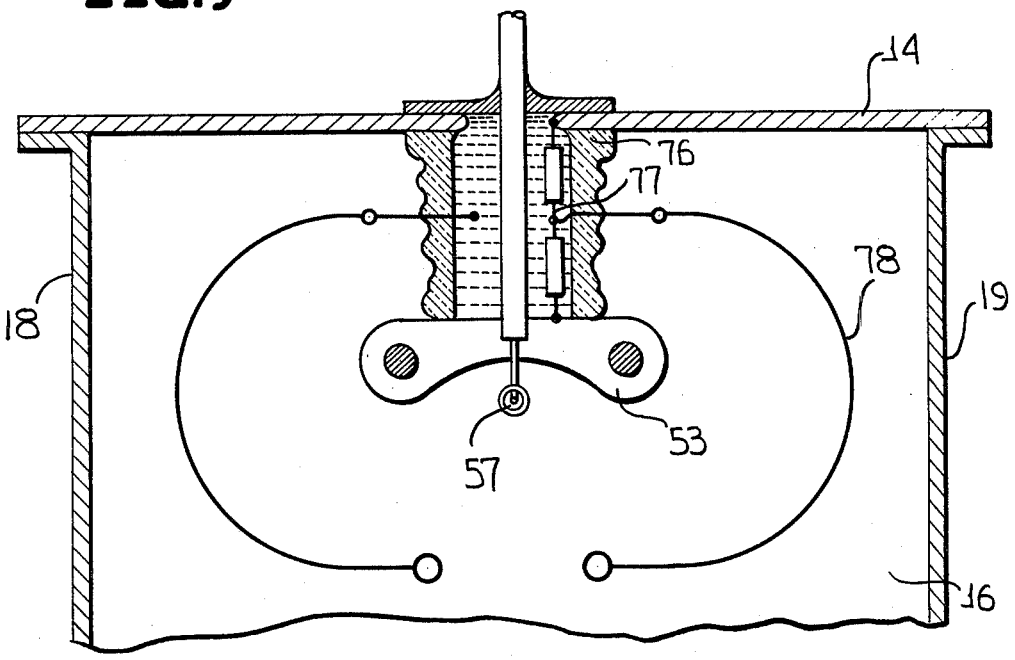
FIG. 9 is a partial view of a preferred embodiment of the apparatus of FIG. 7.

The problem at voltage well over 150,000 volts may be overcome by utilizing the structure of FIG. 9. In FIG. 9 an oil filled cable bushing 76 enters the housing through top wall 14. A resistor string 77 extends between the wall 14 and the cathode 53; being positioned in the oil of the bushing to facilitate cooling and high voltage insulation of the resistor The entire cathode structure 52 as illustrated in FIG. 1, is enclosed in an electrostatic shield 78 supported by the bushing 76 and electrically connected through the bushing to an appropriate voltage on the resistor string 77. Although not apparent from the Figure the shield 78 encloses the ends of the cathode structures as well as the lengths thereof. It should be noted that in FIG. 9 only one cathode structure is illustrated for purpose of simplicity.

The electrostatic shield serves to collect electrons not fully collimated which would otherwise scatter and collect on surrounding elements. The shield also serves as an accelerating electrode and may replace the accelerating electrodes of FIG. 7 or at least the first level of such electrodes. If accelerating electrodes are not required, as in the diode arrangement of FIG. 1, and electrostatic build up is a problem, the shield 78 may be employed but would normally be at a voltage slightly above that of the cathode.

Thus, an important feature of the present invention is the provision by a single accelerator unit with an area beam of electrons emitted from a two-dimensional array of discrete cathodes. The beam has a distribution pattern which is controllable both transversely and longitudinally of material being conveyed through the beam, control being achieved both by adjusting the emission rates of individual cathodes and by selective positioning of the cathodes within the array. With this area beam approach, most irradiation processes can be completed with but a single pass of the material. Moreover, substantially any irradiation pattern may be effected in that single pass. An extremely important advantage which inures to the accelerator of the present invention is the ability to test different materials using different irradiation patterns to determine the optimum pattern for each material.

It is stressed once again that the linearly extended filaments described for purposes of illustration in relation to FIGS. 2 and 3 are not a limiting factor with respect to the present invention. Point filaments, circular filaments, or in fact filaments of any configuration may be employed, depending upon the area beam pattern desired.

In addition, the applicability of the apparatus is not limited to irradiation of material located on a conveyor. The matter to be irradiated may be conveyed past the end of the accelerator by any known means including movement of the matter as a function of the process in which the matter is being utilized, such as a chemical process. Movement may be hydraulic or pneumatic pressure or by thermal currents; the mechanism by which the matter is conveyed not being limiting in any sense on the subject matter of the present invention.

Further, it is not intended to limit the apparatus to utilization of a straight end wall. A curved end wall may be employed with appropriately aligned cathodes. The end wall may be curved along one or both of its dimensions.

While I have described and illustrated specific embodiments of my invention, it will be clear that variations of the details of construction which are specifically illustrated and described may be resorted to without departing from the true spirit and scope of the invention as defined in the appended claims.

What is claimed is:

1. An electron accelerator comprising:

an evacuated enclosure having at least one metallic wall at a first dc potential, said wall having supported therein an electron window arranged to permit emergence from said enclosure of accelerated electrons directed toward said window;

at least a first cathode member mounted for positional adjustability inside said enclosure, said cathode member including means responsive to a second dc potential applied thereto for emitting electrons toward said window, said second dc potential being highly negative relative to said first dc potential; and adjustable means comprising part of said cathode member for selectively controlling the rate of electron emission therefrom.

2. The accelerator according to claim 1 wherein said electron window is extended along a first axis and wherein said cathode member is positionally adjustable along a second axis parallel to said first axis.

3. An electron accelerator comprising an evacuated enclosure having at least one metallic wall at a first dc potential, electron permeable window means in said wall extending along a first axis, at least a first and a second elongated cathode member for emitting electrons, means for mounting said cathode members along a common axis substantially parallel to said first axis, for independent translation therealong, adjustable means for independently controlling the rate of electron emission from each of said cathode members, and means for applying high voltage d.c. between said metallic wall and said cathode members to accelerate electrons emitted by said cathode members towards said window means.

4. The accelerator according to claim 3 wherein said electron window means includes a plurality of electron windows extending parallel to said first axis, each cathode member being responsive to a second dc potential applied thereto for emitting electrons toward a different predetermined electron window.

5. The accelerator according to claim 3 further including: a second electron window means supported in said wall to permit emergence from said enclosure of accelerated electrons directed toward said second window, said second window means extending along a third axis parallel to said first axis; at least a third cathode member mounted along a fourth axis parallel to said third axis and including means responsive to a second dc potential applied thereto emitting electrons toward said second electron window means.

6. The accelerator according to claim 5 further comprising a plurality of said cathode members mounted for positional adjustability along said fourth axis for emitting electrons toward said second electron window means.

7. The accelerator according to claim 3 further comprising a plurality of said cathode members and a plurality of said windows and wherein each of said cathode members has a concave metal surface facing said window, which surface is adapted to be at the same negative high voltage as said filament, and wherein said filament is disposed within the concavity of said surface.

8. The accelerator according to claim 7 including at least one rod on which cathode members are slidably mounted, said rod being arranged to permit cathode members to be selectively slidably removed and replaced thereon.

9. The accelerator according to claim 3 wherein a plurality of parallel rows of said cathode members are provided and are successively spaced along a second dimension of said enclosure in the plane of and transverse to said first axis, said window means including various window means positioned in alignment with electron beams emitted from all such cathode means.

10. The accelerator according to claim 3 wherein at least some of said cathode members include: a filament; and adjustable current control means connected to permit selective adjustment of current flow through said filament.

11. The accelerator according to claim 10 wherein said cathode members further include a concave metal surface, a filament located within the concavity of said surface and an adjustable impedance connected in parallel with said filament.

12. In an electron accelerator, a two dimensional array of at least three electron emitting means, a two dimensional array of electron permeable windows aligned with the direction of movement of electrons accelerated by the accelerator and means for independently varying the electron emissions of said electron emitting means relative to one another.

13. The accelerator according to claim 12 wherein said window means comprise a plurality of elongated mutually parallel electron permeable window means, a plurality of groups of discrete cathode members, each said group of cathode members including a plurality of cathode members disposed along an axis parallel with a different one of said electron permeable elongated windows means.

14. The accelerator according to claim 12 further comprising means for independently adjusting the position of said electron emitting means in said two dimensional array.

* * * * *